United States Patent [19]

Anderson et al.

[11] 4,100,324

[45] Jul. 11, 1978

[54] NONWOVEN FABRIC AND METHOD OF PRODUCING SAME

[75] Inventors: Richard A. Anderson, Menasha; Robert C. Sokolowski; Kurt W. Ostermeier, both of Harrison, all of Wis.

[73] Assignee: Kimberly-Clark Corporation, Neenah, Wis.

[21] Appl. No.: 706,456

[22] Filed: Jul. 19, 1976

Related U.S. Application Data

[63] Continuation-in-part of Ser. No. 454,816, Mar. 26, 1974, abandoned.

[51] Int. Cl.[2] ..... D04H 1/00

[52] U.S. Cl. ..... 428/288; 156/62.2; 156/167; 264/121; 428/297; 428/303; 428/326; 428/401; 428/403

[58] Field of Search ..... 428/280, 288, 296, 297, 428/298, 299, 303, 326, 327, 332, 401, 903; 156/306, 62.2, 220, 167; 264/121

[56] References Cited

U.S. PATENT DOCUMENTS

| | | | |
|---|---|---|---|
| 2,500,282 | 3/1950 | Francis | 264/122 |
| 3,010,161 | 11/1961 | Duvall | 264/115 |
| 3,016,599 | 1/1962 | Perry | 428/903 |
| 3,635,609 | 1/1972 | Balamuth | 264/13 |
| 3,755,028 | 8/1973 | Wood | 156/62.2 |
| 3,787,256 | 1/1974 | Nowotny | 156/62.2 |
| 3,811,957 | 5/1974 | Bunten | 264/126 |

FOREIGN PATENT DOCUMENTS

| | | |
|---|---|---|
| 1,088,991 | 9/1967 | United Kingdom. |

*Primary Examiner*—James J. Bell

*Attorney, Agent, or Firm*—Leydig, Voit, Osann, Mayer & Holt, Ltd.

[57] ABSTRACT

A nonwoven fabric-like material having a unique combination of strength, absorbency and hand consists essentially of an air-formed matrix of thermoplastic polymer microfibers having an average fiber diameter of less than about 10 microns, and a multiplicity of individualized wood pulp fibers disposed throughout the matrix of microfibers and engaging at least some of the microfibers to space the microfibers apart from each other. The wood pulp fibers are interconnected by and held captive within the matrix of microfibers by mechanical entanglement of the microfibers with the wood pulp fibers, the mechanical entanglement and interconnection of the microfibers and wood pulp fibers alone forming a coherent integrated fibrous structure. The coherent integrated fibrous structure may be formed by the microfibers and wood pulp fibers without any adhesive, molecular or hydrogen bonds between the two different types of fibers. The wood pulp fibers are preferably distributed uniformly throughout the matrix of microfibers to provide a homogeneous material. The material is formed by initially forming a primary air stream containing the melt blown microfibers, forming a secondary air stream containing the wood pulp fibers, merging the primary and secondary streams under turbulent conditions to form an integrated air stream containing a thorough mixture of the microfibers and wood pulp fibers, and then directing the integrated air stream onto a forming surface to air form the fabric-like material. The microfibers are in a soft nascent condition at an elevated temperature when they are turbulently mixed with the wood pulp fibers in air.

23 Claims, 15 Drawing Figures

50% SOFT WOOD FIBER
50% POLYPROPYLENE MICROFIBERS
80X MAGNIFICATION

50% SOFT WOOD FIBER
50% POLYPROPYLENE MICROFIBERS
300X MAGNIFICATION

50% SOFT WOOD FIBER
50% POLYPROPYLENE MICROFIBERS
1000X MAGNIFICATION 48.5 SOFT WOOD FIBER
51.5 POLYPROPYLENE MICROFIBERS
600X MAGNIFICATION
UNEMBOSSED AREA 48.5 SOFT WOOD FIBER
51.5 POLYPROPYLENE MICROFIBERS
600X MAGNIFICATION
UNEMBOSSED AREA 48.5 SOFT WOOD FIBER
51.5 POLYPROPYLENE MICROFIBERS
300X MAGNIFICATION
EMBOSSED AREA

NONWOVEN FABRIC AND METHOD OF PRODUCING SAME

CROSS REFERENCE TO RELATED APPLICATION

This application is a continuation-in-part of application Ser. No. 454,816 filed Mar. 26, 1974 now abandoned, and entitled "Nonwoven Fabric And Method Of Producing Same."

DESCRIPTION OF THE INVENTION

The present invention relates generally to nonwoven fabrics and, more particularly, to a wood pulp-containing nonwoven fabric which can be economically produced and tailored to provide a variety of different combinations of properties for different applications.

It is a primary object of the invention to provide an improved nonwoven fabric which can be economically manufactured in a single process step, at high speeds, without the addition of adhesives, and without requiring embossing or other treatment subsequent to the formation of the fabric.

It is another object of the invention to provide such an improved nonwoven fabric in which wood pulp fibers and polymeric fibers are distributed in a controlled manner to provide a desired combination of properties in the final product. A related object is to provide a simple process for the continuous production of such fabrics at high production speeds.

A further object of one specific aspect of the invention is to provide such an improved nonwoven fabric which has a unique combination of strength, absorbency and hand. Thus, a particular object of one aspect of the invention is to provide such a material which has a high absorbency and yet exhibits a wet strength comparable to its dry strength.

Still another specific object of the invention is to provide such an improved nonwoven fabric which combines high bulk and low density with a high degree of resiliency, i.e., ability to recover from deformation, and which can be produced at a relatively low cost.

Yet another object of the invention for certain specific applications is to provide such an improved nonwoven fabric which has a high absorbency for both oil and water.

A further object of the invention is to provide such an improved nonwoven fabric in which the wood pulp fibers exhibit little or no interfiber bonding after being wetted and dried, thereby retaining the original properties of the material to a significant degree. In this connection, a related object of the invention is to provide such a fabric which retains its original physical structure with little change after being wetted and dried.

A still further object of the invention is to provide a process for producing a nonwoven fabric which has a relatively high bulk per unit weight.

Another object of the invention is to provide such a process which uses only air to form the fabric, without wetting the components thereof.

Other objects and advantages of the invention will be apparent from the following detailed description and the accompanying drawings, in which.

While the invention will be described in connection with certain preferred embodiments, it is to be understood that the invention is not to be limited to those embodiments. On the contrary, it is intended to cover all alternatives, modifications, and equivalents as can be included within the spirit and scope of the invention as defined in the appended claims.

Figure 1:
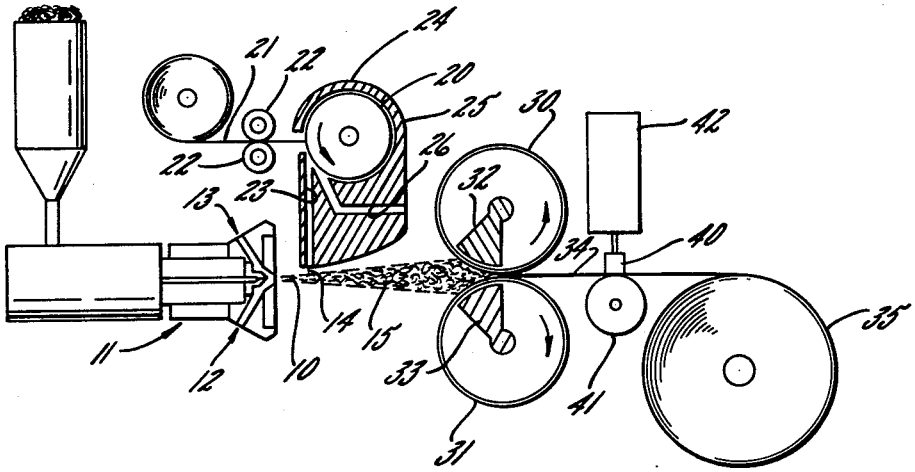
FIG. 1 is a partially schematic side elevation, partially in section, of a method and apparatus for producing nonwoven fabrics in accordance with the present invention.

Turning now to the drawings and referring first to FIG. 1, a primary gas stream 10 containing discontinuous polymeric microfibers is formed by a known melt-blowing technique, such as the one described in an article entitled "Superfine Thermoplastic Fibers," appearing in *Industrial and Engineering Chemistry,* Vol. 48, No. 8, pp. 1342-1346, which describes work done at the Naval Research Laboratories in Washington, D.C. Also, see Naval Research Laboratory Report 111437, dated Apr. 15, 1954, and U.S. Pat. No. 3,676,242, issued July 11, 1972, to Prentice. Basically, the method of formation involves extruding a molten polymeric material through a die head 11 into fine streams and attenuating the streams by converging flows of high velocity, heated gas (usually air) supplied from nozzles 12 and 13 to break the polymer streams into discontinuous microfibers of small diameter. The die head preferably includes at least one straight row of extrusion apertures. In general, the resulting microfibers have an average fiber diameter of up to only about 10 microns with very few, if any, of the microfibers exceeding 10 microns in diameter. The average diameter of the microfibers is usually greater than about 1 micron, and is preferably within the range of about 2–6 microns, averaging about 5 microns. While the microfibers are predominately discontinuous, they generally have a length exceeding that normally associated with staple fibers.

In accordance with an important aspect of one particular embodiment of the present invention, the primary gas stream 10 is merged with a secondary gas stream containing individualized wood pulp fibers so as to integrate the two different fibrous materials in a single step. The individualized wood pulp fibers typically have a length of about 0.5 to 10 millimeters and a length-to-maximum width ratio of about 10/1 to 400/1. A typical cross-section has an irregular width of 30 microns and a thickness of 5 microns. Thus, in the illustrative arrangement a secondary gas stream 14 is formed by pulp sheet divellicating apparatus of the type described and claimed in the assignee's Appel U.S. Pat. No. 3,793,678, entitled "Pulp Picking Apparatus with Improved Fiber Forming Duct." This apparatus comprises a conventional picker roll 20 having picking teeth for divellicating pulp sheets 21 into individual fibers. The pulp sheets 21 are fed radially, i.e., along a picker roll radius, to the picker roll 20 by means of rolls 22. As the teeth on the picker roll 20 divellicate the pulp sheets 21 into individual fibers, the resulting separated fibers are conveyed downwardly toward the primary air stream through a forming nozzle or duct 23. A housing 24 encloses the picker roll 20 and provides a passage 25 between the housing 24 and the picker roll surface. Process air is supplied to the picker roll in the passage 25 via duct 26 in sufficient quantity to serve as a medium for conveying the fibers through the forming duct 23 at a velocity approaching that of the picker teeth. The air may be supplied by any conventional means as, for example, a blower.

It has been found that, in order to avoid fiber floccing, the individual fibers should be conveyed through the duct 23 at substantially the same velocity at which they leave the picker teeth after separation from the pulp sheets 21, i.e., the fibers should maintain their velocity in both magnitude and direction from the point where they leave the picker teeth. More particularly, the velocity of the fibers separated from the pulp sheets 21 preferably does not change by more than about 20% in the duct 23. This is in contrast with other forming apparatus in which, due to flow separation, fibers do not travel in an ordered manner from the picker and, consequently, fiber velocities change as much as 100% or more during conveyance.

In order to maintain the desired fiber velocity, the duct 23 is positioned such that its longitudinal axis is substantially parallel to the plane which is tangent to the picker roll 20 at the point at which the fibers leave the influence of the picker teeth. With this orientation of the duct 23, fiber velocity is not changed by impingement of fibers on the duct walls. Thus, where the pulp sheets 21 are radially fed to the picker in a plane which is substantially parallel to the primary air stream, the plane which is tangent to the picker roll 20 at the point of contact with the pulp sheets is perpendicular to the primary air stream. Accordingly, since for the schematic embodiment illustrated in FIG. 1 the point of picker contact with the sheets is also the point at which the separated fibers leave the influence of the picker teeth, the longitudinal axis of the duct 23 is normal to the primary air stream 10. However, if after separation from the pulp sheets 21 the fibers are constrained to remain under the influence of the picker teeth, then the axis of the duct 23 is appropriately adjusted so as to be in the direction of fiber velocity at that point where constraint is no longer present.

As shown in FIG. 1, the width of the duct is approximately equal to the height of the picker teeth on the roll 20, the passage between the picker teeth and the picker roll housing 24 being very small. With such a duct width, the velocity of the process air supplied through the process air duct 26 remains substantially constant in its travel with the picker and thence through the duct 23. Furthermore, because the velocity of the process air approaches that of the picker teeth, which in turn is about the same as the velocity of the separated fibers, the process air causes no substantial variations in fiber velocity in the duct 23. With duct widths approximately equal to the height of the picker teeth, e.g., no more than about 1.5 times the tooth height, air velocities in the forming duct 23 of at least 70% of the picker tooth velocity are useful in the illustrated apparatus.

Duct length and transverse width, i.e., the width in a direction along the picker roll axis, are also important in order to achieve an optimum web. Preferably, the duct length should be as short as the overall equipment design will allow. For the apparatus schematically illustrated in FIG. 1, the shortest duct length is limited by the radius of the picker roll. In order to achieve a high degree of cross-width uniformity in the resultant web, the transverse duct width preferably should not exceed the width of the pulp sheets fed to the picker roll. Again referring to the apparatus illustrated in FIG. 1, it is preferred that picker teeth with relatively large heights, e.g., greater than ¼ inch, be used. Such heights permit the use of wider ducts which, in turn, minimize the interaction of fibers with the duct walls.

As illustrated in FIG. 1, the primary and secondary gas streams 10 and 14 are preferably moving perpendicular to each other at their point of merger, although other merging angles may be employed if desired. The velocity of the secondary stream 14 is substantially lower than that of the primary stream 10 so that the integrated stream 15 resulting from the merger continues to flow in the same direction as the primary stream 10. Indeed, the merger of the two streams is somewhat like an aspirating effect whereby the fibers in the secondary stream 14 are drawn into the primary stream 10 as it passes the outlet of the duct 23. In any event, it is important that the velocity difference between the two gas streams be such that the secondary stream is integrated with the primary stream in a turbulent manner, so that the fibers in the secondary stream become thoroughly mixed with the melt-blown microfibers in the primary stream. In general, increasing velocity differences between the primary and secondary streams produce more homogeneous integration of the two materials, while lower velocities and smaller velocity differences would be expected to produce concentration gradients of components in the composite material. For maximum production rates, it is generally preferred that the primary air stream have an initial sonic velocity (within the nozzles 12 and 13) and that the secondary air stream have a subsonic velocity. Of course, as the primary air stream exits from the nozzles 12 and 13, it immediately expands with a resulting decrease in velocity.

The capacity of the air stream which attenuates the polymeric microfibers and entrains surrounding air is always larger than the volume of air used to introduce the pulp fibers. The primary air jet typically increases in volume flow more than five fold before the maximum jet velocity has decreased to 20% of its initial value. However, the pulp fibers should be introduced early in the zone of diffusion of the microfiber jet in order to expose the fiber mixture to the intense small-scale turbulence in this area of the diffusion zone, and to mix the fibers while the polymeric microfibers are in a soft nascent condition at an elevated temperature. In the later stages of diffusion of the microfiber jet, the scale of turbulence becomes large compared to the fiber entanglements, and the energy in turbulence is continuously decreasing. The combination of a high-intensity and small-scale turbulence field provides maximum mechanical containment of the small pulp fibers within the matrix of microfibers.

Deceleration of the high-velocity gas stream carrying the microfibers frees the microfibers from the drawing forces which initially form them from the polymer mass. As the microfibers relax they are better able to follow the minute eddies and to entangle and "capture" the relatively short wood pulp fibers while both fiber types are dispersed and suspended in a gaseous medium. The resulting combination is an intimate mixture of wood pulp fibers and polymeric microfibers integrated by physical entrapment and mechanical entanglement while suspended in space. It is preferred to initiate the combining action while the microfibers are still in a softened state at an elevated temperature.

Attenuation of the microfibers occurs both before and after the entanglement of these fibers with the pulp fibers. The total attenuation is from a fiber diameter of about 0.015 inch (which is a typical diameter for the die apertures) to about 5 microns (0.0002 inch) or less. Most of the attenuation occurs within about three inches of the die face, before the air velocity in the fiber stream drops below about 250 feet/second. Since the wood pulp fibers are typically introduced into the microfiber stream about one inch from the die face, attenuation of the microfibers may continue after the merger with the pulp fibers. Due to their extremely small cross-section, the polymeric microfibers are at least 50 to 100 times more flexible than conventional textile fibers made from the same polymer, and are even more flexible and conformable when freshly formed and hot.

Because the microfibers are much longer, thinner, limper and more flexible than the wood pulp fibers, the microfibers twist around and entangle the relatively short, thick and stiff pulp fibers as soon as the two fiber streams merge. This entanglement interconnects the two different types of fibers with strong, persistent inter-fiber attachments without any significant molecular, adhesive or hydrogen bonds. In the resulting matrix the microfibers retain a high degree of flexibility, with many of the microfibers being spaced apart by engagement with the comparatively stiff pulp fibers. The entangled pulp fibers are free to change their orientation when the matrix is subjected to various types of distorting forces, but the elasticity and resiliency of the microfiber network tends to return the pulp fibers to their original positions when the distorting forces are removed. A coherent integrated fibrous structure is formed solely by the mechanical entanglement and interconnection of the two different fibers.

The microfibers and the nature of their anchorage to the wood pulp fibers provide yielding "hinges" between the fibers in the final structure. The fibers are not rigidly bonded to each other, and their connection points permit fiber rotation, twisting and bending. At even moderate microfiber contents, the structure is capable of providing textile-like properties of "hand" and drape, and is conformable while retaining a degree of elasticity and resiliency. Even when wet with water, which softens the wood pulp fibers, the material exhibits flexural resiliency and a wet strength comparable to its dry strength.

Even at microfiber content levels as low as 1% by weight, the containment of the wood pulp fibers is sufficient to provide a significantly improved absorbent material; for example, such material has improved integrity and reduced linting as compared with materials prepared heretofore with similarly high contents of wood pulp fibers. Moreover, this containment of the wood pulp fibers and the other characteristics noted above are achieved in the air-formed fabric without the addition of adhesive and without any further processing or treatment. This improved material also contrasts sharply with materials in which an adhesive is used to contain the wood pulp fibers, with resulting stiffness and reduction in absorbent capacity and rate.

The spatial effect of the wood pulp fibers persists to a relatively high level of microfiber content. Because the pulp fibers maintain their shape and do not melt or undergo substantial morphological change under the temperatures and forces of the microfiber stream, they physically interfere with polymer-to-polymer interactions. This is indicated by an unexpected increase in breaking length or tensile strength at very low microfiber contents, which thereafter falls below a straight line projection of strength level vs. microfiber content, exhibiting an unexpected modification of the microfiber web strength. The wood pulp fibers are preferably distributed uniformly throughout the matrix of microfibers to provide a homogeneous material.

The wood pulp fibers also have been found to reduce the objectionable effects of the polymer aggregates or "shot" that is inevitably produced by most microfiber processes. These polymer aggregates fuse readily to themselves and to adjacent microfibers and contribute to harshness, stiffness and objectionable appearance in a 100% microfiber web. The pulp fibers apparently inhibit the bonding of "shot" particles to each other and to the microfibers and also conceal the "shot" visually and tactually.

Figure 2:
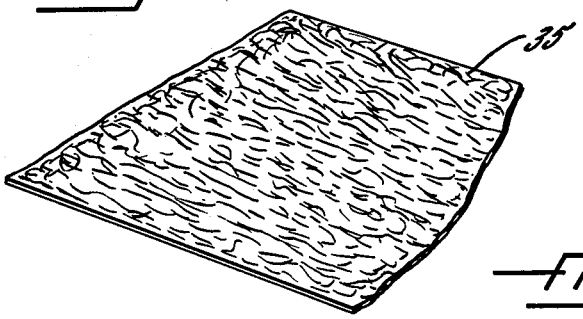
FIG. 2 is a perspective view of a fragment of a nonwoven fabric produced by the method and apparatus of FIG. 1.

In order to convert the fiber blend in the integrated stream 15 into an integral fibrous mat or web, the stream 15 is passed into the nip of a pair of vacuum rolls 30 and 31 having foraminous surfaces that rotate continuously over a pair of fixed vacuum nozzles 32 and 33. As the integrated stream 15 enters the nip of the rolls 30 and 31, the carrying gas is sucked into the two vacuum nozzles 32 and 33 while the fiber blend is supported and slightly compressed by the opposed surfaces of the two rolls 30 and 31. This forms an integrated, self-supporting fibrous web 34 that has sufficient integrity to permit it to be withdrawn from the vacuum roll nip and conveyed to a wind-up roll 35. The web 34 wound on the roll 35 is illustrated in FIG. 2.

The containment of the wood pulp fibers in the integrated fibrous matrix, and the other characteristics noted above, are attained without any further processing or treatment of the airlaid web. However, if it is desired to improve the strength of the composite web 34, it maybe embossed either ultrasonically or at an elevated temperature so that the thermoplastic microfibers are flattened into a film-like structure in the embossed areas. This film-like structure, which will be described in more detail below in connection with the photograph of FIG. 11, functions to hold the pulp fibers more rigidly in place in the embossed areas. Thus, in the illustrative process of FIG. 1, the composite web 34 is passed through an ultrasonic embossing station comprising an ultrasonic calendering head 40 vibrating against a patterned anvil roll 41. The embossing conditions (e.g., pressure, speed, power input) as well as the embossing pattern may be appropriately selected to provide the desired characteristics in the final product. An intermittent pattern is preferred with the area of the web occupied by the embossed areas after passage through the embossing nip being about 5–50% of the surface area of the material and the discrete embossed areas being present in a density of about 50–100/in$^2$.

Figure 4:
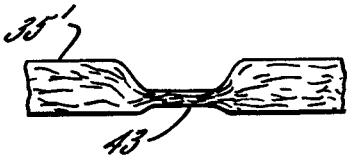
FIG. 4 is a section taken along line 4—4 in FIG. 3.
Figure 3:
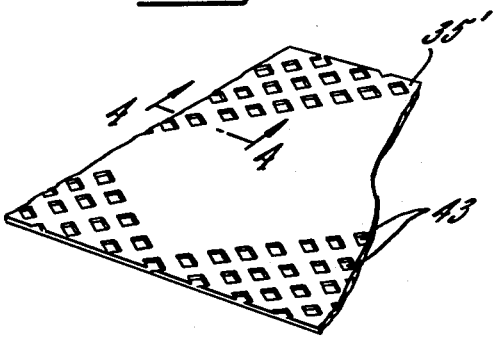
FIG. 3 is a perspective view of the fragment of nonwoven fabric shown in FIG. 2 after being subjected to an embossing operation.

The most appropriate embossing condtions for any given material will depend on the particular components. For materials using polypropylene as the thermoplastic polymer for the microfibers, it has been found that substantial improvements in strength of the nonwoven fabric can be obtained by the use of a Branson ultrasonic system, Model 460 with continuous sonic module, operating against a patterned anvil roll 41 at a pressure of 50 psi on the ultrasonic horn, a power input of 700 watts, and a 10 inch × 0.5 inch horn in contact with the material being embossed. Suitable patterns for the anvil roll are those illustrated in FIGS. 3–5, and suitable web speeds through the embossing station are 25–150 feet per minute.

One of the principal advantages of this invention is that it permits utilization of all the advantages of a melt-blowing process for forming a fibrous mat, while at the same time permitting integration of the melt-blown microfibers with different amounts and types of wood pulp fibers that can be selected to provide the final product with a variety of different combinations of desired properties that cannot be realized by the use of a melt-blowing process alone. Consequently, this process can be used to produce different materials that are especially tailored for a wide variety of different applications. For example, mats of polymeric microfibers can be efficiently produced at high production rates by a melt-blowing operation, but such mats are not generally suitable for use as wipes because of their limited liquid retention and absorbency characteristics. However, by using the process of this invention to integrate wood pulp fibers with the microfibers produced by the melt-blowing operation, the liquid retention and absorbency characteristics of that mat can be improved to a level that makes the mat perfectly suitable for use as a wipe. Furthermore, the wood pulp fiber is often more readily available and less expensive than the polymeric material used to form the melt-blown microfibers so the integration of the two different types of fibers reduces the cost of the resulting composite mat. Although the nonwoven fabrics of this invention exhibit certain properties attributable to the pulp fibers, the fabric always contains a substantial amount of the thermoplastic microfibers. Consequently, the composite fabric can be modified by secondary thermal treatments such as hot calendering, embossing or spot bonding.

An additional advantage of the integration of the two different fibrous materials via turbulent mixing of the two gas streams is the attainment of a homogeneous distribution of both fibrous materials throughout the final composite web. As mentioned previously, this result is achieved by maintaining a substantial difference in the velocities of the two streams, with larger velocity differences leading to more homogeneous integration and smaller velocity differences producing concentration gradients of the secondary material throughout the primary material. If desired, a product can be made with uniform properties in any direction in the plane of the web, without any substantial variations in thickness due to embossing or the like.

A wide variety of thermoplastic polymers are useful in forming the melt-blown microfibers, so that materials can be fashioned with different physical properties by the appropriate selection of polymers or combinations thereof. Among the many useful thermoplastic polymers, polyolefins such as polypropylene and polyethylene, polyamides, polyesters such as polyethylene teraphthalate, and thermoplastic elastomers such as polyurethanes are anticipated to find the most widespread use in the preparation of the materials described herein.

The picker roll shown in the illustrative arrangement is preferred for producing the secondary air stream containing the wood pulp fibers. However, other devices may be used to generate secondary air streams containing additional fibrous and/or particulate materials, including synthetic fibers such as staple nylon fibers and natural fibers such as cotton, flax, jute and silk. If desired, the wood pulp fibers and an additional material may be carried in a single secondary air stream.

In order to achieve a particular combination of properties in the final fibrous web, there are a number of variables in both the primary and secondary air streams that can be controlled along with the composition and basis weight of the web. Process parameters susceptible to control in the primary gas stream are the gas temperature, which is preferably in the range of 600° to 700° F; the gas velocity, which is preferably in the sonic range within the die; the polymer extrusion rate, which is preferably in the range of 0.25 grams per hole per minute; the polymer temperature; and the ratio of air to polymer (mass flow rates) which is preferably in the range of 10/1 to 100/1. Variables that can be controlled in the secondary gas stream are the gas flow rate and velocity of the picker roll; the gas velocity wich is preferably in the sub-sonic range, e.g., 50–250 feet per second; and the fiber size which is typically on the order of 3.0 millimeters in length. The relationship between the primary and secondary gas streams can also be controlled, and it is generally preferred that the ratio of the gas velocities in the primary and secondary streams be in the range of from 5/1 to 10/1. The relative percentages of the materials introduced by the primary and secondary gas streams may vary over a wide range, but it is typical for the polymeric microfiber to comprise from about 1% to 80% by weight of the final mat. The angle between the primary and secondary gas streams at the point of their merger may also be varied, but it is generally preferred to have the two streams come together perpendicular to each other. Similarly, the particular point at which the two streams are merged, relative to the melt-blowing die in the upstream direction and foranimous forming surface in the downstream direction, may be varied.

The following examples illustrate the preparation of nonwoven materials in accordance with the present invention. The results of measurements of certain physical properties of the materials so prepared and of their individual constituents are also reported. The measurements were made substantially in accordance with the following procedures:

Uncompressed thickness

A Custom Scientific Instruments thickness tester was used with a 1 $in^2$ foot applying pressure to the material at 0.5 oz./$in^2$ in Examples I-X, and with a 7.07 $in^2$ foot applying pressure to the material at 0.004 psi in the remaining examples.

Bulk density

Bulk density in $g/cm^3$ was calculated using the measured uncompressed thickness and known sample basis weight (bulk density = basis weight/thickness).

Oil absorbency

A material sample four inches square is weighed, placed in a room temperature bath of mineral oil for 30 seconds, and then removed and drained by suspending on a glass rod for 45 seconds. The sample is then weighed again and any increase in weight is the amount of oil absorbed by the sample. This weight is then divided by the density of the oil (0.831 g/ml) to give the volumetric equivalent, which is divided by the dry weight of the sample to give "oil absorbency."

Water absorbency

Same as oil absorbency test using water in place of oil. The absorbency tests in Tables II and III were done using 0.5% aqueous solution of Aerosol OT surfactant to ensure uniform wetting of all samples.

Breaking length

A tensile strength test is conducted with an Instron tester (Model No. A70) using a material sample 1.0 inch wide and 3 inches long (a longer sample is used, but a length of 3 inches is exposed between the jaws of the tester). The sample is loaded at a rate of 10 inches/minute at 70–72° F and 40–50% relative humidity. The measured tensile strength is then divided by the basis weight of the sample to give the breaking length. To measure the wet breaking length, the sample is immersed in water for 0.5 minute and then laid on a blotter to remove excess water before testing. To measure redried breaking length, the sample is wetted as just described and then air dried before testing.

Stretch

The increasing length of the sample is measured during the tensile strength test described above, and the percentage increase in length of the sample just prior to break of the sample is its stretch.

Lint count

A material sample six inches square is fastened to the peripheries of two parallel circular plates spaced four inches away from each other on a common vertical axis. The sample is then bent, twisted and crushed by moving one of the plates repetitively into engagement with the other plate while rotating the moving plate 180° relative to the other plate during each advancing stroke. This repetitive plate movement is continued for 50 cycles with a Millipore filter No. HAWP-047-00, 47-mm. diameter, 0.45-micron pore size, positioned beneath the sample with the center of the filter located just slightly outside the peripheries of the two plates. The particles caught on the filter are then viewed through a microscope via a TV camera and monitor at 40X magnification, and all particles greater than 13 microns are counted in nine different fields of 1.64 × 2.43 mm. on the filter. Eight of these nine fields are evenly spaced around the circumference of the filter, and the ninth field is located in the center of the filter. The nine resulting particle counts are then averaged, and the resulting average count is recorded as the "lint count".

Specific volume

"Initial specific volume" is determined by dividing the uncompressed thickness (as measured by the above procedure using the 7.07 $in^2$ foot applying pressure to the material at 0.004 psi), in centimeters, by the basis weight of the sample, in grams per square centimeter. The sample is then loaded uniformly across its surface at a pressure of 0.49 psi; after one minute the compressed thickness under this load is measured with the same thickness tester described above, and the resulting compressed thickness is divided by the basis weight to obtain the "loaded specific volume." The load is then removed from the sample; after one minute the thickness of the recovered sample is measured in the same manner described above for the uncompressed thickness (using the 7.07 $in^2$ foot applying pressure at 0.004 psi); and the resulting recovered thickness is divided by the basis weight to obtain the "recovered specific volume."

EXAMPLE I

A composite fabric ontaining 53.5% bleached sulfite pulp fibers and 46.5% melt blown polypropylene microfibers was prepared in accordance with the general procedure described above and illustrated in FIG. 1. The polypropylene (Exxon resin, CD-523) was extruded at a rate of 22 lbs./hr. (equivalent to 0.42 g/min. per die orifice) at a final temperature of 600° F., and was attenuated in the primary air streams flowing at a sonic velocity and a combined rate of 1500 lbs./hr. at a temperature of 700° F. A secondary air stream containing suspended pulp fluff was generated by defiberizing roll pulp (Rayfluff XQ, which is Western hemlock pulp with an average fiber length of 2.1 mm), in a picker unit using a gas flow rate of 1500 lbs./hr., and this secondary stream was directed perpendicularly into the flow of primary air and polypropylene microfibers about 1 inch from the die tip. The velocity of the primary stream was estimated to be 5–10 times the velocity of the secondary stream at the point of entrainment. The composite web was collected between vacuum rolls in a wireroll nip gapped at 12.5 mils. and 22 inches distant from the extrusion die tip. The following composite fabric properties were measured:

Basis Weight: 99 $g/m^2$
Uncompressed Thickness: 1.55 mm
Bulk density: 0.064 $g/cm^3$
Oil Absorbency: 18.8 ml/g
Machine Direction Breaking Length: 196 m
Machine Direction Stretch: 20%
Cross Direction Breaking Length: 358 m
Cross Direction Stretch: 34%

The web can be further characterized as felt-like or cloth-like, compressible and cushiony, conformable and non-papery. These properties suggest possible uses as: diaper material, polishing cloth, small bandages, meat and poultry pads, makeup removal pads, barber and beauty aid products. In addition, the material was found to be very efficient in picking up and retaining small particulate matter such as dust, and could be effectively used as a dust cloth. Although this material contains a major part by weight of hydrophylic wood pulp fiber, it is not readily wettable by water. This property is advantageous in applicator pads, for cosmetics, and other applications where it is desirable to isolate the material being applied on the surface of the pad.

EXAMPLE II

Figure 5:
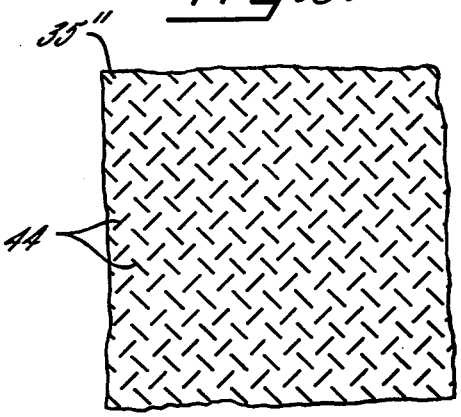
FIG. 5 is a perspective view of a fragment of a nonwoven fabric produced by the method and apparatus of FIG. 1 using a different embossing pattern.

A portion of the composite fabric of Example I was embossed via ultrasonic calendering against an anvil roll forming the embossing pattern illustrated in FIG. 5. The following properties were measured:

Basis Weight: 91 $g/m^2$
Thickness: 0.81 mm
Bulk Density: 0.112 $g/cm^3$
Oil Absorbency: 8.8 ml/g
Machine Direction Breaking Length: 882 m
Machine Direction Stretch: 36%
Cross Direction Breaking Length: 444 m
Cross Direction Stretch: 26%

The fabric can be further characterized as being stronger and stiffer than the unembossed material of Example I, although still cloth-like. Embossing also results in decreased surface lint by more firmly fixing segments of individual pulp fibers in the embossed areas. Applications include a disposable dishcloth, durable industrial or household wipes, napkins, and wet wipe applications if saturated with cleansers, astrigents, etc.

EXAMPLE III

A composite fabric containing 52% fiberized pulp (Rayfluff XQ) and 48% polypropylene (Exxon resin, CD-523) melt blown fiber was prepared as in Example I, with the exception that the distance from the forming roll nip to the extrusion die tip was 14 $\frac{7}{8}$ inches. The following properties were measured:

Basis Weight: 92.3 g/m$^2$
Thickness: 0.74 mm
Bulk Density: 0.125 g/cm$^3$
Oil Absorbency: 9.7 ml/g
Machine Direction Breaking Length: 693 m
Machine Direction Stretch: 10%
Cross Direction Breaking Length: 590 m
Cross Direction Stretch: 18%

This material, by comparison with the material of Example I, is stiffer, denser, and less conformable, with its tactile properties being more papery than cloth-like with a somewhat abrasive surface texture as a result of surface embossing on the wire forming roll surface. It is not readily wettable. The material could be used as clothing interfacing, limited-use placemats and tablecloths.

EXAMPLE IV

A portion of the composite fabric of Example III was embossed via ultrasonic calendering against an anvil roll forming the embossing pattern illustrated in FIG. 5. The following properties were measured:

Basis Weight: 92.5 g/m$^2$
Thickness: 0.71 mm
Bulk Density: 0.130 g/cm$^3$
Oil Absorbency: 7.2 ml/g
Machine Direction Breaking Length: 694 m
Machine Direction Stretch: 22%
Cross Direction Breaking Length: 644 m
Cross Direction Stretch: 27%

This material is sufficiently strong and durable for use in scrubbing and scouring. This material is not readily wettable. In addition, this material may be used in limited use placemats and tablecloths.

EXAMPLE V

A composite fabric containing 47.6% fiberized pulp (Rayfluff XQ) and 52.3% polypropylene (Exxon resin, CD-523) melt blown fiber was prepared in accordance with the general procedure described above. The polypropylene resin was modified by the addition of surfactant material in the extrusion process at a level of 6.5% by weight of the melt blown fibers. The modified fiber was extruded at a rate of 23 lbs./hr. at a final temperature of 575° F., and was attenuated in the primary air streams flowing at a sonic velocity and a combined rate of 1500 lbs./hr. at a temperature of 700° F. Addition and integration of the pulp fiber was accomplished as in Example I. The resultant material was readily wettable by water and the following composite properties were measured:

Basis Weight: 94.5 g/m
Thickness: 1.42 mm
Bulk Density: 0.066 g/cm
Oil Absorbency: 17.9 ml/g
Water Absorbency: 14.2 ml/g
Machine Direction Breaking Length: 159 m
Machine Direction Stretch: 39%
Cross Direction Breaking Length: 168 m
Cross Direction Stretch: 63%

With the exception that this web was readily wetted by aqueous media, it was very similar in quality to that described in Example I and has similar potential uses.

EXAMPLE VI

A portion of the composite fabric of Example V was embossed via ultrasonic calendering againt anvil roll forming the embossing pattern illustrated in FIG. 5. The following properties were measured:

Basis Weight: 94 g/m$^2$
Thickness: 0.71 mm
Bulk Density: 0.132 g/cm$^3$
Oil Absorbency: 8.0 ml/g
Water Absorbency: 6.2 ml/g
Dry Machine Direction Breaking Length: 801 m
Dry Machine Direction Stretch: 39%
Dry Cross Direction Breaking Length: 680 m
Dry Cross Direction Stretch: 45%
Wet Machine Direction Breaking Length: 754 m
Wet Machine Direction Stretch: 43%
Wet Cross Direction Breaking Length: 572 m
Wet Cross Direction Stretch: 48%
Redried Machine Direction Breaking Length: 778 m
Redried Machine Direction Stretch: 50%
Redried Cross Direction Breaking Length: 649 m
Redried Cross Direction Stretch: 61%

The material is potentially useful as a limited use or durable general purpose wiping cloth for both dry and wet use because of the good retention of physical and mechanical properties when in the wet state, or upon redrying from the wet state.

EXAMPLE VII

A composite fabric containing 74% fiberized pulp (Rayfluff XQ) and 26% polypropylene (Exxon resin, CD-523) melt blown fiber was prepared as in Example I, with the exceptions that the distance from the forming wire surface to the extrusion die tip was 30$\frac{1}{4}$ inches and the wire roll nip gas was 105 mils. The following properties were measured:

Basis Weight: 181 g/m$^2$
Uncompressed Thickness: 4.06 mm
Bulk Density: 0.045 g/cm
Oil Absorbency: 26.8 ml/g
Machine Direction Breaking Length: 59 m
Machine Direction Stretch: 24%
Cross Direction Breaking Length: 139 m
Cross Direction Stretch: 40%

This material is further characterized as soft, bulky, compressible and cushiony -- somewhat resembling a cotton batt. Its high absorbent capacity suggests application in catamenial napkins, diapers and wound dressings. Further applications include a makeup removal pad, applicator pads, packing material, cosmetic padding (e.g., brassieres), barber and beauty aid products, infant care products and decorative applications.

EXAMPLE VIII

A composite containing 35.6% high crimped nylon staple fiber, 2.5 dpf (denier per fiber) and 1.375 inches long with 64.6% melt blown polypropylene fiber, was prepared by directing a secondary air stream conveying the suspended staple fibers perpendicularly into the primary stream of hot air and melt blown polypropylene fibers about 2 inches from the die tip. Melt blown fibers were generated by extruding polypropylene resin at a rate of 0.25 g/min. per die orifice at a final temperature of 630° F., an attenuating the extruded polymer in the primary air flowing at a mass flow rate 81 times that of the total polymer flow and at a temperature of 690° F. The secondary stream was formed by passing a carded web of the nylon staple fiber through a pair of feed rolls into a fiber gun formed by a pair of nozzles located on opposite sides of the web. High velocity air jets issuing from the nozzle break the carded web into individual fibers and fiber bundles in a high velocity fluid stream. From the nozzles, the resulting high velocity fluid stream entered a duct which conducted the fiber stream to the primary stream of melt blown fibers. The composite web was collected on a wire covered vacuum roll surface 5.5 inches distant from the extrusion die tip. The following composite properties were measured:

Basis Weight: 56 g/m$^2$
Dry Machine Direction Breaking Length: 518 m
Dry Machine Direction Stretch: 77%
Wet Machine Direction Breaking Length: 573 m
Wet Machine Direction Stretch: 87%
Dry Cross Machine Breaking Length: 330 m
Dry Cross Machine Stretch: 92%
Wet Cross Machine Breaking Length: 323 m
Wet Cross Machine Stretch: 78%

This web was characterized by an improved degree of toughness, tensile strength and stretch, suggesting that staple length fibers might be used as a third component to impart these properties to pulp-microfiber composites described in the above examples. Possible uses for either the bi-component or tri-component fabrics containing staple fiber additions would be in the areas of fabric interfacings, durable industrial or household wipes, wet wipe applications if saturated with cleaners, etc., limited use placemats and table cloths and similar nonwoven fabric applications.

EXAMPLE IX

A composite fabric containing 50% hardwood pulp fiber and 50% melt blown polypropylene microfibers was prepared in accordance with the general procedure described and illustrated in FIG. 1. The polypropylene (Exxon resin, CD-523 precompounded to contain 10% by weight surfactant) was extruded at a rate of 0.33 g/min/die orifice at a final temperature of 635° F., and was attenuated in the primary air streams flowing at a mass flow rate 58 times that of the total polymer flow and at a temperature of 690° F. The secondary air stream containing suspended pulp fiber was generated by defiberizing roll pulp (hard wood having an average fiber length of 1.5 mm) in a picker unit without a stripping flow of picker air and directed perpendicularly into the flow of primary air and polypropylene microfibers about 2 inches from the die tip. The composite web was collected on a wire covered vacuum roll surface 5.5 inches distant from the extrusion die tip. The following composite properties were measured:

Basic Weight: 85 g/m$^2$
Thickness: 1.57 mm
Bulk Density: 0.054 g/cm$^3$
Water Absorbency: 15.8 ml/gm
Dry Machine Direction Breaking Length: 137 m
Dry Machine Direction Stretch: 33%
Dry Cross Direction Breaking Length: 83 m
Dry Cross Direction Stretch: 59%

This web was readily wettable by water and had an extremely soft feel. It had the same drape as the webs described above, but a softer surface texture.

EXAMPLE X

A composite fabric containing 50% cedar pulp fiber and 50% melt blown polypropylene microfibers was prepared as in Example IX. The secondary stream of pulp fiber was generated by defiberizing Cedanier roll pulp having an average fiber length of 3.9 mm. The following composite properties were measured:

Basis Weight: 83 g/m$^2$
Thickness: 1.77 mm
Bulk Density: 0.047 g/cm$^3$
Water Absorbency: 18.9 ml/gm
Dry Machine Direction Breaking Length: 119 m
Dry Machine Direction Stretch: 26%
Dry Cross Direction Breaking Length: 60 m
Dry Cross Direction Stretch: 46%

The resulting web was readily wettable by water.

In each of the above examples where ultrasonic calendering was employed, the equipment used was the Branson system described previously with a 50 psi setting on the horn and a web throughput rate of 27 feet/-minute.

Figure 6:
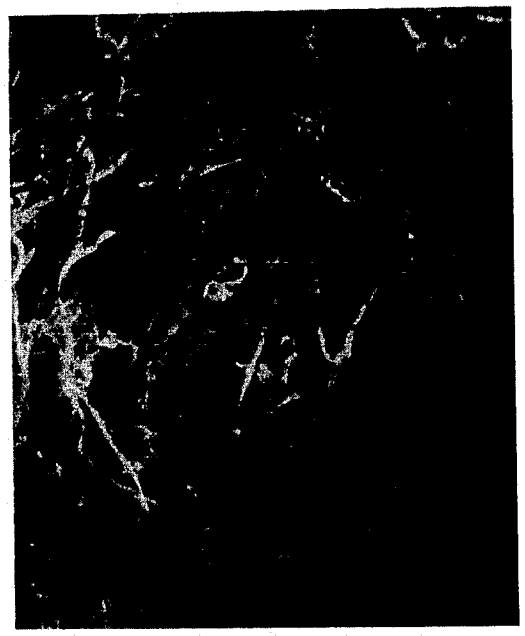
FIGS. 6–8 are scanning electron microscope photographs, at different magnification levels, of an exemplary material embodying the invention.
Figure 7:
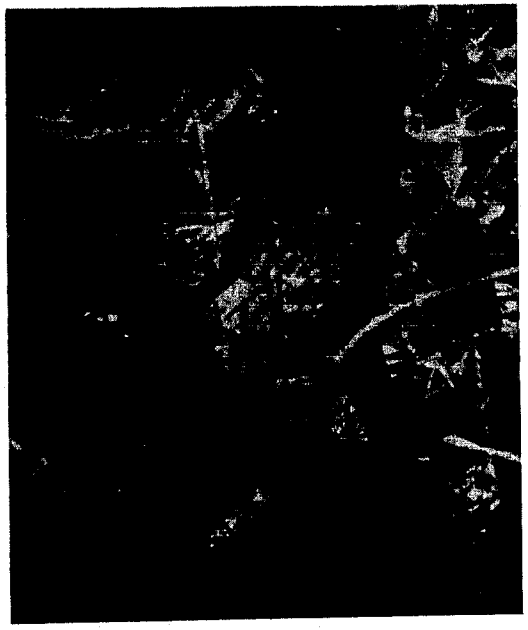
Figure 8:
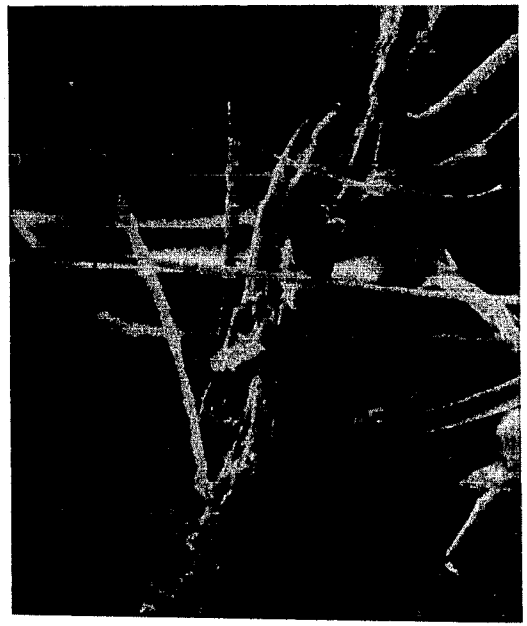

FIGS. 6–8 are scanning electron microscope photographs of a fabric prepared in a manner similar to that described in Example VIII but containing 50.4% softwood pulp fibers (Longlac-18, which is spruce and jack pine pulp with an average fiber length of 3.2 mm) and 49.6 melt blown polypropylene fibers (Exxon resin, CD-392), with a polypropylene extrusion rate of 0.31 g/min. per die orifice and a primary air/polymer mass flow rate ratio of 66.6/1. FIG. 6 (80X magnification) shows the homogeneity of the integrated fiber system, the randomness of the fiber lay, the gross entanglement of pulp and melt blown fibers, and the relative fiber diameters of the pulp and the melt blown microfibers. FIG. 7 (300X magnification) further illustrates the gross entanglement of the melt blown microfibers with the pulp fibers, the relative fiber dimensions and the large void volume of the web. FIG. 8 (1000X magnification) depicts a portion of a pulp fiber held by multiple microfiber entanglements. Some variation in the melt blown fiber diameter is evident with 3–5 microns being typical. Bonding between polyproplyene fibers in the web is not extensive, but such bonding does occur as illustrated with those fibers of larger diameter and others of varying size (in this case, between a fiber of about 14 microns diameter and one of about 5 microns). This type of bonding is rare in bulky, low density webs and the main basis for the web integrity appears to be the extensive physical entanglement of both the pulp fibers and the melt blown microfibers. No evidence of bonding of the polypropylene fibers to the cellulose pulp fibers was found. This lack of fiber bonding contributes to the great softness, flexibility and drape of the low density webs.

Because of the homogeneous composition of both the surface and the interior parts of the fabric, the properties of both the synthetic microfibers and the entrained pulp fibers are exhibited. For example, even in composites containing a major proportion of pulp fibers, the presence of low surface energy microfibers at the surface limits the wettability of the composite fabric. The distribution of thermoplastic fibers throughout the web also results in an ability to thermally modify the web structure via such operations as calendering, spot bonding and lamination to other thermoplastic webs or films.

Figure 9:
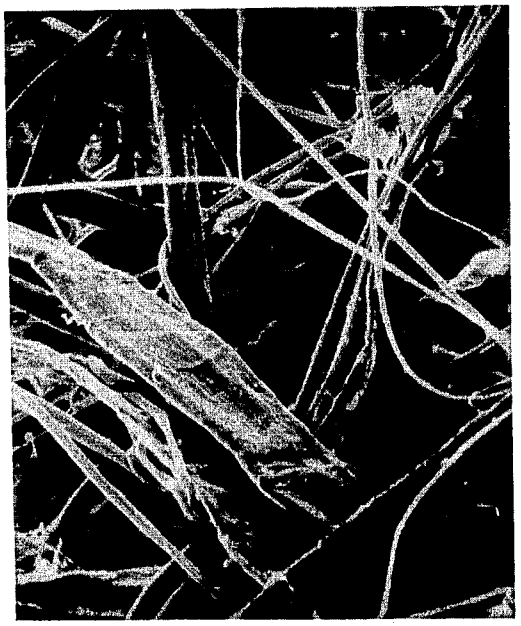
FIGS. 9–11 are scanning electron microscope photographs of a second exemplary material embodying the invention, FIGS. 9 and 10 showing unembossed areas of the material and FIG. 11 showing an embossed area.
Figure 10:
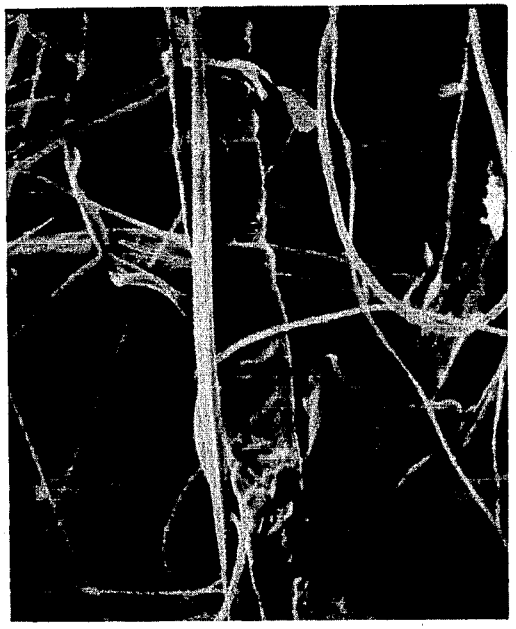
Figure 11:
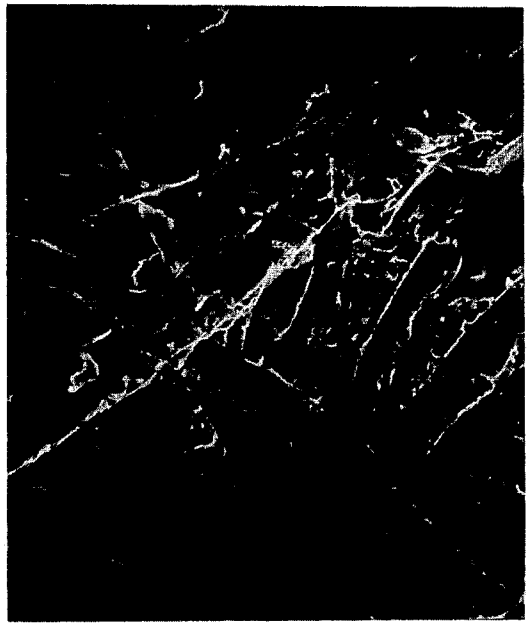

FIGS. 9–11 are scanning electron microscope photographs of a fabric prepared in the manner described in Example VIII but containing 48.5% softwood pulp fibers (Longlac-18, which is spruce and jack pine pulp with an average fiber length of 3.2 mm) and 51.5% polypropylene melt blown fibers (Exxon resin, CD-392), with a 700° F. air temperature, a 665° F. polymer temperature, an extrusion rate of 0.28 g/min. per die orifice, and a primary air/polymer mass flow rate ratio of 85/1. This fabric was further densified by ultrasonic calendering against an anvil roll forming the embossing pattern illustrated in FIG. 3 and 4. FIG. 9 and 10 again show the grossly entagled melt blown microfibers and pulp fibers in the densified but unbonded portions of the web. FIG. 11 shows a bonded area which was formed by the more intense web calendering action at an area such as area 43 in FIG. 4. The fibrous structure of the thermoplastic fibers has been lost in this embossed area, and the resulting film acts to hold the pulp fibers in this area more rigidly in place. Fabrics calendered in this manner typically exhibit increased tensile strength and density, with decreased liquid absorbency, but enhanced fluid transfer or wicking properties.

The presence of the hydrophobic non-water-sensitive fibers imparts stability in water and aqueous media to the composite fabric. The polyolefinic fibers further provide high capacity for oil and solvent absorbency. The incorporation of pulp fibers within the matrix of melt blown microfibers results in increased bulkiness and open structure. The total composite structure has good integrity and abrasion resistance by virtue of the gross entanglement of the pulp fibers with the microfibers and requires no further addition of adhesive to stabilize the web structure, although such adhesive addition is readily possible if desired.

EXAMPLE XI

The five series of seven samples each identified in Table I on the following page comprise a wide range of microfiber-to-wood pulp fiber ratios as indicated. The microfibers were made from polypropylene resin (Hercules PC973) which was extruded at the rates and temperatures indicated for each series. The primary air velocity was subsonic in each case, ranging from 830 to 1390 fps., but at a constant temperature of 665° F. The secondary air stream containing suspended pulp fluff was generated by defiberizing roll pulp (Rayfloc XJ, which is Southern pine pulp with an average fiber length of about 3.0 mm.) in a picker unit using a gas flow rate of about 1440 #/hr. and initial velocity of 77 fps. The composite webs were collected on a single foraminous vacuum roll 7.5 inches from the extrusion die tip. Composite fabric properties measured for series A through E as well as 100% pulp, air-formed batt of Rayfloc XJpulp are summarized in Table II.

TABLE I

| | EXTRUDER AND PRIMARY AIR | | | | | PICKER | | SERIES NUMBER | | | | | | |
|---|---|---|---|---|---|---|---|---|---|---|---|---|---|---|
| Sample Series | Polymer #hr. | Primary Air, #hr. | Die Temp. ° F. | Air Temp. ° F. | Air Velocity Ft./Sec. | Air Velocity Ft./Sec. | Secondary Air #/hr. | 1 | 2 | 3 | 4 | 5 | 6 | 7 |
| | | | | | | | | %, MICRO FIBER IN COMPOSITE | | | | | | |
| A(1–7) | 13.6 | 312 | 637 | 665 | 830 | 77 | 1440 | 7 | 9 | 12 | 19 | 41 | 70 | 100 |
| B(1–7) | 13.6 | 436 | 637 | 665 | 1125 | 77 | 1440 | 7 | 9 | 12 | 19 | 41 | 70 | 100 |
| C(1–7) | 29.2 | 436 | 643 | 665 | 1125 | 77 | 1440 | 14 | 17 | 22 | 33 | 59 | 83 | 100 |
| D(1–7) | 45.0 | 436 | 637 | 665 | 1125 | 77 | 1440 | 19 | 24 | 31 | 42 | 69 | 88 | 100 |
| E(1–7) | 45.0 | 568 | 637 | 665 | 1390 | 77 | 1440 | 19 | 24 | 31 | 42 | 69 | 88 | 100 |
| F(1,2) | 2.9 | 436 | 550 | 555 | 1125 | 77 | 1440 | 1.5 | 3.0 | | | | | |

The above data demonstrates the broad spectrum effect of microfibers in the 7–31% range (and even lower) on breaking length, water absorbency, and specific volume recovery properties. For example, 100% wood pulp fiber shows less than 50% recovery after being loaded at 0.49 psi. Even the poorest material containing both types of fibers showed more than 60% recovery and most of the samples showed 80% or higher recovery values.

The water absorbency data also shows the significant effect of 7% (and even lower) microfiber contents on the composite material. This represents an important advantage over 100% wood pulp fiber in uses where liquid-absorbing capacity is required pulp fiber in uses where liquid-absorbing capacity is required (as in diapers and feminine napkins). The ability to increase absorbing capacity at low cost makes it possible to offer superior-performing products in highly competitive markets.

Where greater product integrity is required, microfiber contents of 40% to 60% can be utilized. Absorbency values in this range remain attractively high even though the microfiber polymer is hydrophobic.

TABLE II

| Percent Polymer Microfibers: | 0 | 7 | 9 | 12 | 14 | 17 | 19 | 20 | 22 | 24 | 31 | 33 | 41 | 42 | 59 | 69 | 70 | 83 | 88 | 100 |
|---|---|---|---|---|---|---|---|---|---|---|---|---|---|---|---|---|---|---|---|---|
| **Series A** | | | | | | | | | | | | | | | | | | | | |
| Specific Volume (cc/gr) | | | | | | | | | | | | | | | | | | | | |
| Initial | 47 | 41 | 34 | 43 | | | 36 | | | | | | 30 | | | | 24 | | | 16 |
| Loaded at .49 PSI | 12 | 11 | 13 | 14 | | | 13 | | | | | | 13 | | | | 11 | | | 9 |
| Recovered | 23 | 37 | 34 | 38 | | | 34 | | | | | | 29 | | | | 21 | | | 15 |
| Absorbency (gr/gr) (1) | 14 | 21.51 | 20.46 | 21.80 | | | 21.70 | | | | | | 19.00 | | | | 15.76 | | | 6.29 |
| Lint Count (2) | — | 272 | 305 | 216 | | | 306 | | | | | | 149 | | | | 182 | | | 24 |
| Breaking Length (meters) MD | Nil | 15.9 | 15.2 | 25.8 | | | 53.3 | | | | | | 143.4 | | | | 250.5 | | | 573.4 |
| Breaking Length (meters) CD | Nil | 12.9 | 14.7 | 25.1 | | | 47.6 | | | | | | 81.6 | | | | 202.5 | | | 277.2 |
| **Series B** | | | | | | | | | | | | | | | | | | | | |
| Specific Volume (cc/gr) | | | | | | | | | | | | | | | | | | | | |
| Initial | 47 | 38 | 34 | 35 | | | 33 | | | | | | 32 | | | | 25 | | | 16 |
| Loaded at .49 PSI | 12 | 16 | 14 | 15 | | | 13 | | | | | | 14 | | | | 12 | | | 8 |
| Recovered | 23 | 36 | 34 | 35 | | | 32 | | | | | | 32 | | | | 25 | | | 14 |
| Absorbency (gr/gr) (1) | 14 | 21.57 | 22.09 | 21.30 | | | 21.13 | | | | | | 15.21 | | | | 14.13 | | | 3.94 |
| Lint Count (2) | — | 179 | 119 | 152 | | | 147 | | | | | | 75 | | | | 52 | | | 17 |
| Breaking Length (meters) MD | Nil | 19.5 | 23.4 | 26.7 | | | 37.5 | | | | | | 99.9 | | | | 266.3 | | | 602.1 |
| Breaking Length (meters) CD | Nil | 16.0 | 37.4 | 52.3 | | | 69.2 | | | | | | 157.8 | | | | 173.6 | | | 482.8 |
| **Series C** | | | | | | | | | | | | | | | | | | | | |
| Specific Volume (cc/gr) | | | | | | | | | | | | | | | | | | | | |
| Initial | 47 | | | | 45 | 36 | | | 44 | | | 39 | | | 26 | | | 15 | | 8 |
| Loaded at .49 PSI | 12 | | | | 16 | 16 | | | 15 | | | 15 | | | 13 | | | 9 | | 5 |
| Recovered | 23 | | | | 37 | 33 | | | 40 | | | 36 | | | 25 | | | 14 | | 8 |
| Absorbency (gr/gr) (1) | 14 | | | | | 20.20 | | | 25.27 | | | | | | 19.16 | | | | | 4.60 |
| Lint Count (2) | — | | | | 224 | 338 | | | 233 | | | 155 | | | 110 | | | 29 | | 23 |
| Breaking Length (meters) MD | Nil | | | | 26.6 | 29.7 | | | 39.2 | | | 51.9 | | | 185.2 | | | 527.2 | | 929.5 |
| Breaking Length (meters) CD | Nil | | | | 44.5 | 32.5 | | | 56.1 | | | 79.4 | | | 176.8 | | | 321.1 | | 410.6 |
| **Series D** | | | | | | | | | | | | | | | | | | | | |
| Specific Volume (cc/gr) | | | | | | | | | | | | | | | | | | | | |
| Initial | 47 | | | | | | | 34 | | 31 | 30 | | | 27 | | 17 | | | 9 | 6 |
| Loaded at .49 PSI | 12 | | | | | | | 18 | | 16 | 12 | | | 14 | | 11 | | | 6 | 3 |
| Recovered | 23 | | | | | | | 32 | | 30 | 19 | | | 27 | | 17 | | | 8 | 5 |
| Absorbency (gr/gr) (1) | 14 | | | | | | | 21.85 | | 20.83 | 20.24 | | | 16.76 | | 11.29 | | | 5.37 | 2.16 |
| Lint Count (2) | — | | | | | | | 245 | | 202 | 128 | | | 162 | | 82 | | | 23 | 22 |
| Breaking Length (meters) MD | Nil | | | | | | | 57.06 | | 94.64 | 120.3 | | | 132.3 | | 413.5 | | | 896.2 | 1311 |
| Breaking Length (meters) CD | Nil | | | | | | | 43.34 | | 41.61 | 100.1 | | | 59.25 | | 257.4 | | | 554.3 | 637.4 |
| **Series E** | | | | | | | | | | | | | | | | | | | | |
| Specific Volume (cc/gr) | | | | | | | | | | | | | | | | | | | | |
| Initial | 47 | | | | | | | 29 | | 30 | 34 | | | 26 | | 18 | | | 10 | 6 |
| Loaded at .49 PSI | 12 | | | | | | | 16 | | 16 | 17 | | | 15 | | 11 | | | 7 | 3 |
| Recovered | 23 | | | | | | | 31 | | 29 | 32 | | | 25 | | 17 | | | 10 | 5 |
| Absorbency (gr/gr) (1) | 14 | | | | | | | 20.99 | | 20.90 | 21.26 | | | 18.52 | | 12.71 | | | 5.25 | 2.45 |
| Lint Count (2) | — | | | | | | | 228 | | 115 | 208 | | | 184 | | 54 | | | 42 | 69 |
| Breaking Length (meters) MD | Nil | | | | | | | 73.33 | | 101.13 | 97.38 | | | 123.2 | | 417.6 | | | 856.5 | 1102 |
| Breaking Length (meters) CD | Nil | | | | | | | 65.56 | | 69.22 | 66.48 | | | 119.1 | | 283.3 | | | 456.8 | 492.7 |

(1) Absorbency of 100% pulp fiber batt measured by supporting batt on screen because of their extreme lack of integrity.
(2) Lint count cannot be measured on 100% pulp fiber batts because their extreme lack of integrity precludes testing.

As might be expected, the breaking length values increase steadily with increasing contents of microfiber. However, there is an unexpected and commercially important jump in breaking length at microfiber contents as low as 3% and even down to 1%. This means that a web containing as much as 99% wood pulp fiber can be assembled, conveyed and processed mechanically without sophisticated handling techniques. Also, absorbent batts having superior integrity for use in diapers can be made without the use of adhesives or other special stabilizing techniques.

EXAMPLE XII

Two samples containing 1.5% and 3% microfiber, respectively, were prepared in the same manner as the samples in Example XI, but at somewhat lower rates, die temperatures, and air temperatures. The following properties were measured for these two samples:

| Percent Polymer Microfiber in Composite | 1.5 | 3.0 |
|---|---|---|
| Specific Volume (cc/g) | | |
| Initial | 49 | 54 |
| Loaded at .49 psi | 18 | 17 |
| Recovered | 40 | 42 |
| Absorbency (g/g) | 21.1 | 21.0 |
| Breaking Length (m) | | |
| MD | 6.5 | 13.2 |
| CD | 10.2 | 28.8 |

Figure 12:
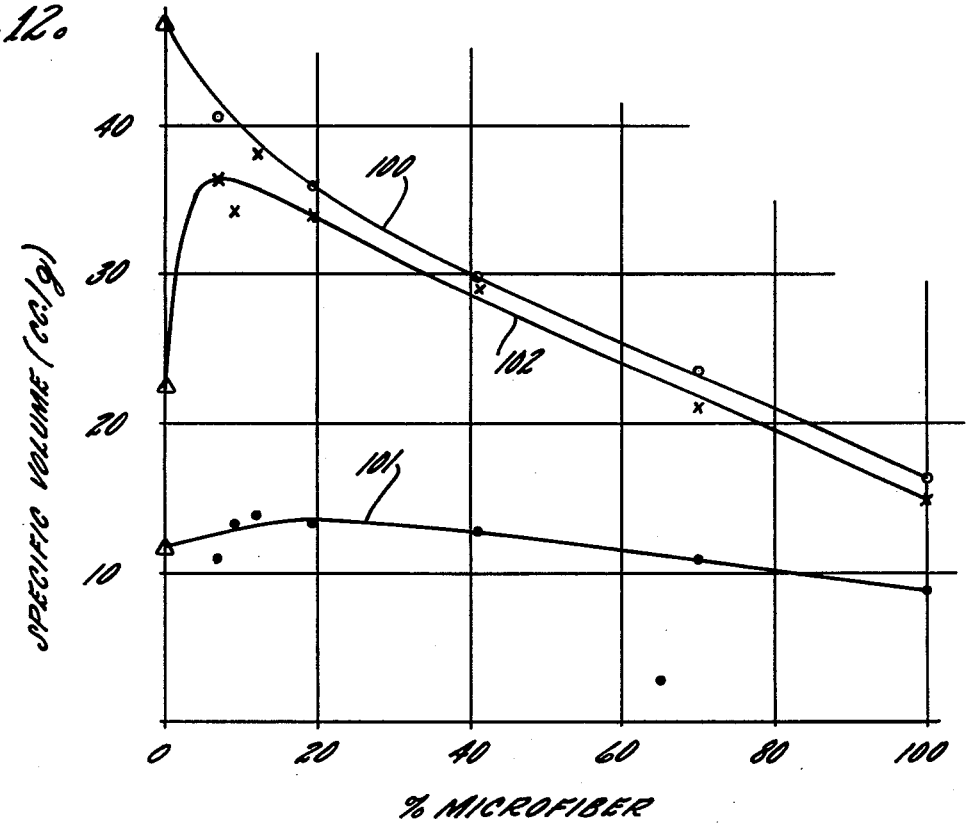
FIGS. 12–15 are graphs illustrating the data collected in certain of the examples described in the application.
Figure 13:
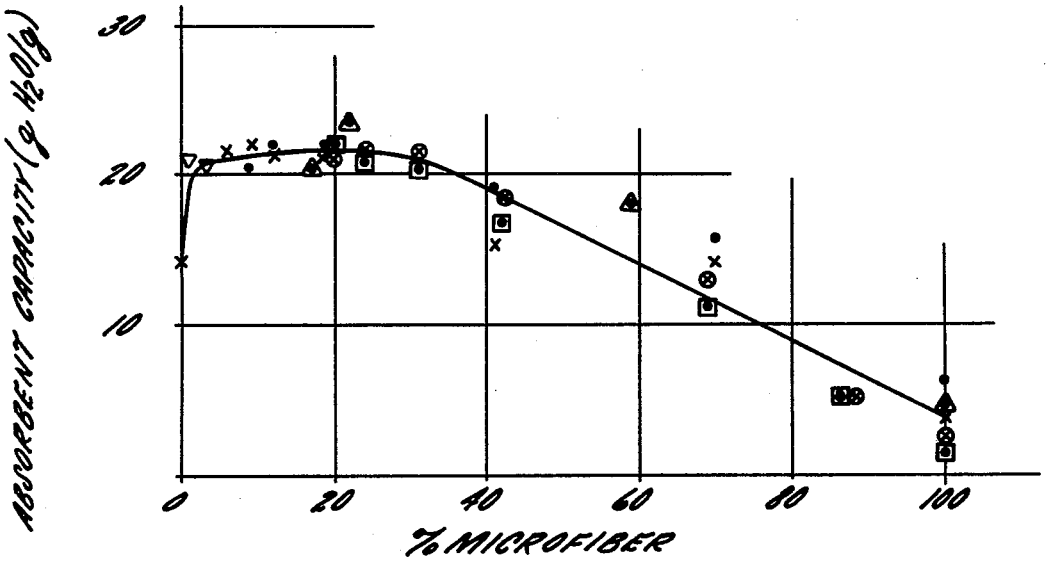
Figure 14:
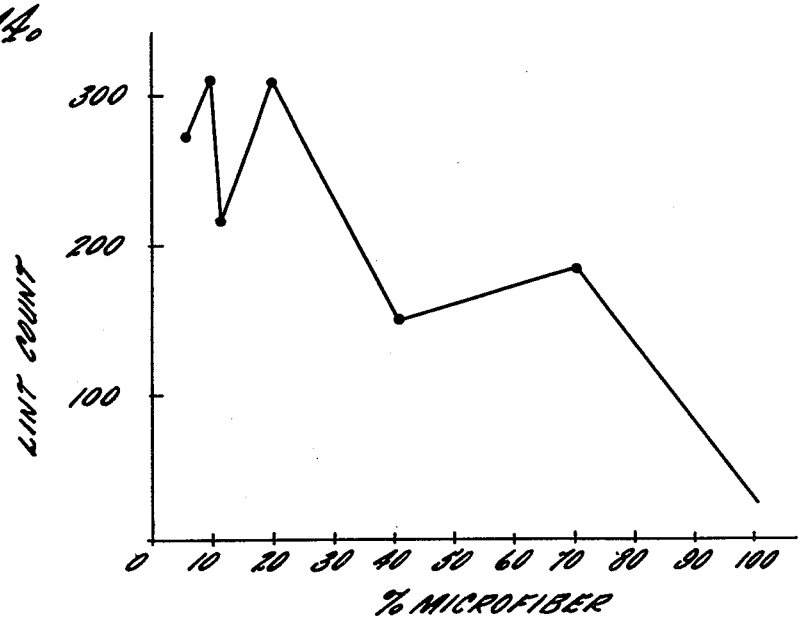
Figure 15:
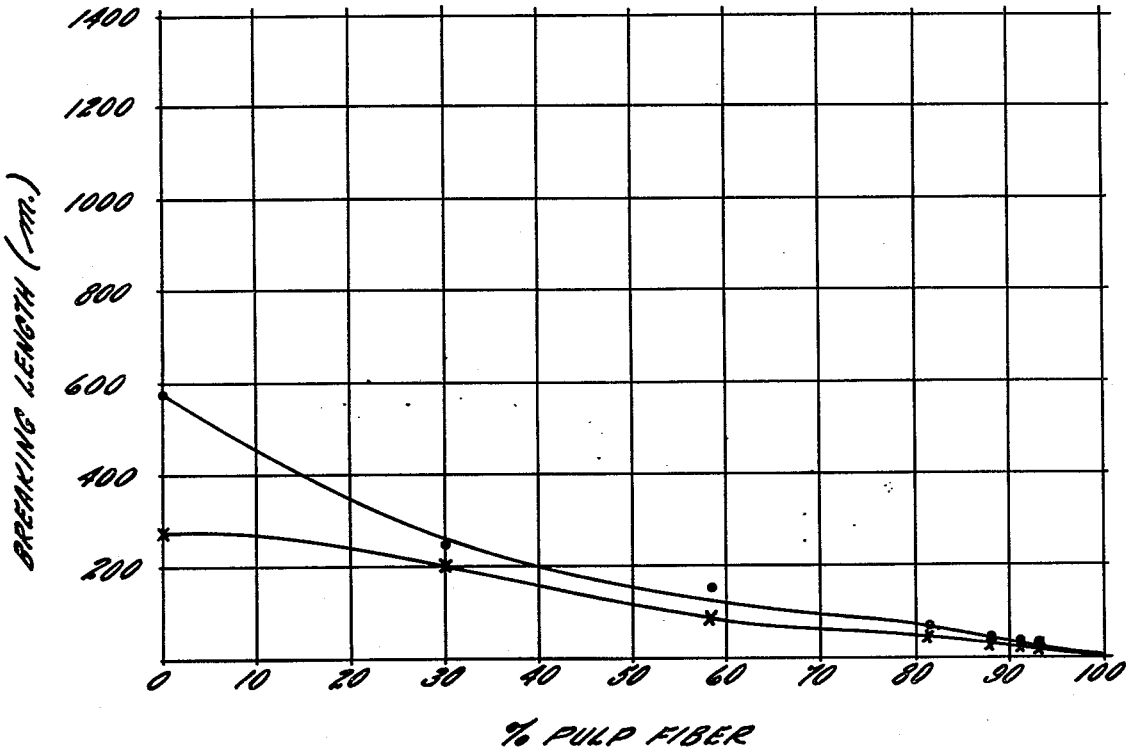

In FIGS. 12 through 15, certain of the properties measured in the above Examples XI and XII have been illustrated graphically. In FIGS. 13, 14 and 15, the horizontal axis represents increasing microfiber contents; in FIG., 15, the horizontal axis represents increasing contents of wood pulp fiber.

In FIG. 12, curve 100 represents the initial specific volume, curve 101 represents the loaded specific volume, and curve 102 represents the recovered specific volume. It can be seen that the recovered specific volume increases dramatically at the lowest levels of microfiber content (this effect is further demonstrated by the data in Example XII which has not been plotted in FIG. 12), and is always at least 25 cc/g even at the lowest microfiber levels.

In FIG. 13, the data for all five series of samples in Example XI, plus the two samples of Example XII, have been plotted, but only a single curve has been drawn because of the relatively close spacing of the plotted data. In the plotted data, the dots represent Series A, the x's represent Series B, the dots in triangles represent Series C, the dots in squares represent Series D, the x's in circles represent Series E, and the triangles represent the two samples of Example XII. It can be seen from FIG. 13 that there is a dramatic increase in absorbency even at the lowest microfiber level of 1.5%, and the absorbency remains above the level of a 100% wood pulp material up to a microfiber level of at least about 50%. At microfiber contents of 30% and greater, the absorbency is greater than 30 minus 0.25 times the microfiber percentage by weight.

In FIG. 14, the lint count is plotted for sample Series A in Example XI. This curve illustrates the integrity of the composite fabric, and the significant improvement over a 100% wood pulp material, which cannot even be measured by conventional techniques because of its extreme lack of integrity. The lint count is less than 600 minus 5.5 times the microfiber percentage by weight.

In FIG. 15, the breaking length is plotted for sample Series A in Example XI. In the plotted data, the dots represent the machine direction breaking through, and the x's represent the cross direction breaking length. It can be seen from these curves that the breaking length in both directions increases steadily with increasing microfiber content. Even at pulp contents above 90%, the breaking length is always at least 5 meters, which indicates that the fabric can be transported across a free span of 5 meters without breaking.

We claim as our invention:

1. A nonwoven gas-formed fabric-like material having a unique combination of strength, absorbency and hand, said material consisting essentially of a gas-formed matrix of thermoplastic polymeric melt-blown microfibers having an average fiber diameter of less than about 10 microns, and a multiplicity of individualized and gas-formed wood pulp fibers disposed throughout said matrix of microfibers and engaging at least some of said microfibers to space the microfibers apart from each other, said wood pulp fibers being interconnected by and held captive within said matrix of microfibers by mechanical entanglement of said microfibers with said wood pulp fibers, the mechanical enganglement and interconnection of said microfibers and wood pulp fibers alone forming a coherent integrated fibrous structure.

2. A nonwoven fabric-like material as set forth in claim 1 wherein said polymeric microfibers and wood pulp fibers have been mixed under turbulent conditions in air with said microfibers in a soft nascent condition at an elevated temperature.

3. A nonwoven fabric-like material as set forth in claim 1 wherein said microfibers and wood pulp fibers form a coherent integrated fibrous structure without any adhesive, molecular or hydrogen bonds between said microfibers and said wood pulp fibers.

4. A nonwoven fabric-like material as set forth in claim 1 wherein said wood pulp fibers are distributed uniformly throughout said matrix of microfibers to provide a homogeneous material.

5. A nonwoven fabric-like material as set forth in claim 1 wherein said wood pulp fibers have a length within the range of from about 0.5 mm. to about 10 mm., and the ratio of the length of the largest transverse dimension of said wood pulp fibers is within the range of from about 10:1 to about 400:1.

6. A nonwoven fabric-like material as set forth in claim 1 wherein said microfibers have an average fiber diameter greater than about 1 micron.

7. A nonwoven fabric-like material as set forth in claim 1 wherein said polymeric microfiber comprises from about 1% to about 80% by weight of the material.

8. A nonwoven fabric-like material as set forth in claim 1 wherein the recovered specific volume of said material is at least 75% of the initial specific volume.

9. A nonwoven fabric-like material as set forth in claim 1 in which said polymeric microfiber comprises less than about 25% by weight of said material.

10. A nonwoven fabric-like material as set forth in claim 1 wherein said polymeric microfiber comprises at least 5% by weight of said material, and the lint count of said material is less than 600 minus 5.5 times the percentage by weight of said microfiber in said material.

11. A nonwoven fabric-like material as set forth in claim 1 wherein said wood pulp fiber comprises at least 40% by weight of said material, and the recovered specific volume of said material is at least 25.

12. A nonwoven fabric-like material as set forth in claim 1 wherein said polymeric microfiber comprises at least about 30% by weight of said material, and the absorbency of said material is greater than 30 minus 0.25 times the percentage by weight of said microfiber in said material.

13. A nonwoven fabric-like material as set forth in claim 1 wherein said wood pulp fiber comprises at least about 90% by weight of said material, and the breaking length of said material is at least 5 meters.

14. A nonwoven fabric-like material as set forth in claim 1 wherein said material has an initial specific volume of at least 25, a recovered specific volume which is at least 75% of the initial specific volume, a lint count of less than 600 minus 5.5 times the percentage by weight of said microfibers in said material, an absorbency greater than 30 minus 0.25 times the percentage by weight of said microfibers, and a breaking length of at least 5 meters.

15. A method of forming a nonwoven fabric-like material having a unique combination of strength, absorbency and hand, said method comprising the steps of:

(a) forming a primary air stream containing melt-blown microfibers comprising generally discontinuous thermoplastic polymeric microfibers, said primary air stream having a temperature in the range of from about 600° F. to about 700° F., (b) forming a secondary air stream containing individualized wood pulp fibers, (c) merging said secondary stream with said primary stream under turbulent conditiions to form an integrated air stream containing a thorough mixture of said microfibers and said wood pulp fibers, (d) and directing said integrated air stream onto a forming surface to air-form a matrix of said microfibers in which at least some of said microfibers are engaged by said individualized wood pulp fibers to space the microfibers apart from each other, and said individualized wood pulp fibers are disposed throughout said matrix of microfibers and interconnected by and held captive within said matrix by mechanical entanglement of said microfibers with said wood pulp fibers, the mechanical entanglement and interconnection of said microfibers and wood pulp fibers alone forming a coherent integrated fibrous structure.

16. A method as set forth in claim 15 wherein said microfibers are formed by attenuating polymeric filaments extruded from at least one straight row of extrusion apertures.

17. A method as set forth in claim 15 wherein said polymeric microfibers are in a soft nascent condition at an elevated temperature when said primary stream is merged with said secondary stream.

18. A method as set forth in claim 15 wherein said microfibers and wood pulp fibers form a coherent integrated fibrous structure without any adhesive, molecular or hydrogen bonds between said microfibers and said wood pulp fibers.

19. A method as set forth in claim 15 wherein said wood pulp fibers are distributed uniformly throughout said microfibers to provide a homogeneous material.

20. A method as set forth in claim 15 wherein said wood pulp fibers have a length within the range of from about 0.5 mm. to about 10 mm., and the ratio of the length to the largest transverse dimension of said wood pulp fibers is within the range of from about 10:1 to about 400:1.

21. A method as set forth in claim 15 wherein said microfibers have an average fiber diameter greater than about 1 micron.

22. A method as set forth in claim 15 wherein said polymeric microfiber comprises from about 1% to about 80% by weight of the fiber mixture.

23. A method as set forth in claim 15 in which said polymeric microfiber comprises less than about 25% by weight of said fiber mixture.

* * * * *

UNITED STATES PATENT OFFICE

CERTIFICATE OF CORRECTION

Patent No. 4,100,324 Dated July 11, 1978

Inventor(s) Richard A. Anderson et al.

It is certified that error appears in the above-identified patent and that said Letters Patent are hereby corrected as shown below:

Column 20, line 22, delete "enganglement" and insert in place thereof --entanglement--.

Column 20, line 43, after "of the length" delete "of", and insert in place thereof --to--.

Column 21, line 30, delete "conditiions" and insert in place thereof --conditions--.

Signed and Sealed this

Ninth Day of January 1979

[SEAL]

*Attest:*

RUTH C. MASON
*Attesting Officer*

DONALD W. BANNER
*Commissioner of Patents and Trademarks*